US008574426B2

(12) United States Patent
Mezza et al.

(10) Patent No.: US 8,574,426 B2
(45) **Date of Patent: *Nov. 5, 2013**

(54) EXTRACTION OF POLYCYCLIC AROMATIC COMPOUNDS FROM PETROLEUM FEEDSTOCKS USING IONIC LIQUIDS

(75) Inventors: Beckay J. Mezza, Arlington Heights, IL (US); Alakananda Bhattacharyya, Glen Ellyn, IL (US); Haiyan Wang, Hoffman Estates, IL (US); Christopher P. Nicholas, Evanston, IL (US)

(73) Assignee: UOP LLC, Des Plaines, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 13/447,385

(22) Filed: Apr. 16, 2012

(65) Prior Publication Data

US 2013/0153470 A1 Jun. 20, 2013

Related U.S. Application Data

(60) Provisional application No. 61/570,950, filed on Dec. 15, 2011.

(51) Int. Cl.

| | |
|---|---|
| ***C10G 21/24*** | (2006.01) |
| ***C10G 21/12*** | (2006.01) |
| ***C10G 21/06*** | (2006.01) |
| ***C07C 7/10*** | (2006.01) |

(52) U.S. Cl.
USPC ..... 208/87; 208/263; 208/311; 585/864

(58) Field of Classification Search
CPC ..... C10G 21/06; C10G 21/08; C10G 21/12; C10G 21/16; C10G 21/18; C10G 21/20; C10G 21/22; C10G 21/24; C10G 21/28
USPC ..... 208/87, 89, 96, 187, 188, 208 R, 211, 208/236, 237, 238, 251 R, 254 R, 262.1, 208/265, 289, 292, 298, 311; 585/860, 864, 585/865, 867
See application file for complete search history.

(56) References Cited

U.S. PATENT DOCUMENTS

| | | | | |
|---|---|---|---|---|
| 4,359,596 | A * | 11/1982 | Howard et al. | 585/856 |
| 4,376,040 | A * | 3/1983 | Sader | 208/180 |
| 5,494,572 | A * | 2/1996 | Horii et al. | 208/263 |
| 7,019,188 | B2 * | 3/2006 | Smith et al. | 585/809 |
| 7,198,712 | B2 * | 4/2007 | Olivier-Bourbigou et al. | 208/238 |
| 7,553,406 | B2 * | 6/2009 | Wasserscheid et al. | 208/236 |
| 2008/0221353 | A1 * | 9/2008 | Tsunashima | 564/12 |
| 2008/0245705 | A1 * | 10/2008 | Siskin et al. | 208/177 |
| 2009/0288992 | A1 * | 11/2009 | Victorovna Likhanova et al. | 208/237 |
| 2010/0051509 | A1 * | 3/2010 | Martinez Palou et al. | 208/237 |
| 2010/0270211 | A1 * | 10/2010 | Wolny | 208/243 |
| 2011/0155637 | A1 * | 6/2011 | Serban et al. | 208/88 |
| 2011/0203972 | A1 * | 8/2011 | Gargano et al. | 208/236 |

FOREIGN PATENT DOCUMENTS

| | | | | |
|---|---|---|---|---|
| EP | 1854786 | A1 * | 11/2007 | C07D 213/84 |
| WO | WO 2007138307 | A2 * | 12/2007 | C10F 21/27 |

OTHER PUBLICATIONS

Manuela Serban, Joseph Kocal, Peter Kokayeff, and Chris Gosling, Diesel Desulfurization to Make ULSD—Overcoming Nitrogen Inhibition, UOP LLC, AIChE Spring 2008 National Meeting, Presented Apr. 7, 2008.*

* cited by examiner

*Primary Examiner* — Nina Bhat
*Assistant Examiner* — Jonathan Miller
(74) *Attorney, Agent, or Firm* — Mark Goldberg

(57) ABSTRACT

The present invention involves a process for removing one or more polycyclic aromatic hydrocarbon compounds from a vacuum gas oil comprising contacting the vacuum gas oil with a vacuum gas oil-immiscible phosphonium ionic liquid to produce a mixture comprising the vacuum gas oil and the vacuum gas oil-immiscible phosphonium ionic liquid, and separating the mixture to produce a vacuum gas oil effluent and a vacuum gas oil-immiscible phosphonium ionic liquid effluent, the vacuum gas oil-immiscible phosphonium ionic liquid effluent comprising the polycyclic aromatic hydrocarbon compound.

16 Claims, No Drawings

EXTRACTION OF POLYCYCLIC AROMATIC COMPOUNDS FROM PETROLEUM FEEDSTOCKS USING IONIC LIQUIDS

CROSS-REFERENCE TO RELATED APPLICATION

This application claims priority from Provisional Application No. 61/570,950 filed Dec. 15, 2011, the contents of which are hereby incorporated by reference.

BACKGROUND OF THE INVENTION

Conventionally, petroleum refiners fractionate crude oil in a crude distillation zone to produce more desirable hydrocarbon fraction products such as vacuum gas oil (VGO). In general, further processing or additional treatments are required before the hydrocarbon fractions meet the necessary product specifications. It is often beneficial to selectively remove polycyclic aromatic hydrocarbon (PAH) compounds as these compounds are believed to be at least partially responsible for soot emissions from typical diesel engines and are believed to be coke precursors. PAH compounds are hydrocarbons containing two or more fused rings wherein at least one ring is aromatic. Specific examples include, but are not limited to, naphthalene, acenaphthene, pyrene, hexahydropyrene, indene, fluoroanthrene, and alkylated derivatives such as 7,12-dimethylbenzanthracene.

VGO is a typical feedstock for fluidized catalytic cracking (FCC) based upgrading processes. The contaminants in VGO such as sulfur, nitrogen, metals and polycyclic aromatics cause deactivation of the FCC catalyst, thereby decreasing gasoline and distillate yields on a per-pass basis. A significant portion of the contaminants are present as highly aromatic compounds. Sometimes the contaminant content of VGO feeds are reduced by hydrotreating the feed to remove nitrogen, metals, sulfur and PAHs. An example of PAH reduction by hydrotreating is U.S. Pat. No. 7,794,588. However, this process uses hydrogen, in a costly process step. Additionally, hydroprocessing of feeds reduced in contaminants is significantly easier than processing highly contaminated feeds.

This invention relates to a process to upgrade VGO feeds by selectively extracting aromatic compounds from them by treatment with certain phosphonium based ionic liquids. Removal of the aromatics from hydrocarbon fractions such as VGO will have a beneficial impact on downstream processing conditions. It can be envisioned that similar aromatic compounds could be extracted from other hydrocarbon streams as well.

SUMMARY OF THE INVENTION

The current invention selectively extracts polycyclic aromatic hydrocarbons (PAHs) from a VGO stream prior to the FCC or hydrocracking conversion step, by means of a selective extraction, using specific ionic liquids that target PAH compounds. The current invention then regenerates the ionic liquid using a regeneration solvent such as water, by which the PAH compounds are segregated out of the ionic liquid phase.

In an embodiment, the invention is a process for removing PAHs from a VGO comprising contacting the VGO with a VGO-immiscible phosphonium ionic liquid to produce a VGO and VGO-immiscible phosphonium ionic liquid mixture, and separating the mixture to produce a VGO effluent and a VGO-immiscible phosphonium ionic liquid effluent comprising the PAHs.

In a further embodiment, the mixture comprises water in an amount less than 10% relative to the amount of VGO-immiscible phosphonium ionic liquid in the mixture on a weight basis; the mixture may be water free.

In an embodiment, the invention is a process for removing PAHs with a Clar's Rule structure of greater than or equal to one disjoint aromatic π-sextet from a VGO feed. In a further embodiment, the PAHs with greater than or equal to one disjoint aromatic π-sextet are reduced by at least 25%.

In an embodiment, the VGO-immiscible phosphonium ionic liquid comprises at least one ionic liquid from at least one of tetraalkylphosphonium dialkylphosphates, tetraalkylphosphonium dialkyl phosphinates, tetraalkylphosphonium phosphates, tetraalkylphosphonium tosylates, tetraalkylphosphonium sulfates, tetraalkylphosphonium sulfonates, tetraalkylphosphonium carbonates, tetraalkylphosphonium metalates, oxometalates, tetraalkylphosphonium mixed metalates, tetraalkylphosphonium polyoxometalates, and tetraalkylphosphonium halides. In another embodiment, the VGO-immiscible phosphonium ionic liquid comprises at least one of trihexyl(tetradecyl)phosphonium chloride, trihexyl(tetradecyl)phosphonium bromide, tributyl(methyl) phosphonium bromide, tributyl(methyl)phosphonium chloride, tributyl(hexyl)phosphonium bromide, tributyl(hexyl) phosphonium chloride, tributyl(octyl)phosphonium bromide, tributyl(octyl)phosphonium chloride, tributyl(decyl)phosphonium bromide, tributyl(decyl)phosphonium chloride, tetrabutylphosphonium bromide, tetrabutylphosphonium chloride, triisobutyl(methyl)phosphonium tosylate, tributyl(methyl)phosphonium methylsulfate, tributyl(ethyl) phosphonium diethylphosphate, and tetrabutylphosphonium methanesulfonate.

DETAILED DESCRIPTION OF THE INVENTION

In general, the invention may be used to remove at least one polycyclic aromatic hydrocarbon (PAH) from a vacuum gas oil (VGO) hydrocarbon fraction through use of a VGO-immiscible phosphonium ionic liquid. PAH compounds are hydrocarbons containing two or more fused rings wherein at least one ring is aromatic. Specific examples include, but are not limited to, naphthalene, acenaphthene, pyrene, hexahydropyrene, indene, fluoroanthrene, and alkylated derivatives such as 7,12-dimethylbenzanthracene.

The terms "vacuum gas oil", "VGO", "VGO phase" and similar terms relating to vacuum gas oil as used herein are to be interpreted broadly to receive not only their ordinary meanings as used by those skilled in the art of producing and converting such hydrocarbon fractions, but also in a broad manner to account for the application of our processes to hydrocarbon fractions exhibiting VGO-like characteristics. Thus, the terms encompass straight run VGO as may be produced in a crude fractionation section of an oil refinery, as well as, VGO product cuts, fractions, or streams that may be produced, for example, by coker, deasphalting, and visbreaking processing units, or which may be produced by blending various hydrocarbons.

In general, VGO comprises petroleum hydrocarbon components boiling in the range of from about 100° to about 720° C. In an embodiment, the VGO boils from about 250° to about 650° C. and has a density in the range of from about 0.87 to about 0.95 g/cm$^3$. In another embodiment, the VGO boils from about 95° to about 580° C.; and in a further embodiment, the VGO boils from about 300° to about 720° C. In an embodiment, the PAH content of the VGO ranges from about 100 ppm-wt to about 5 wt %. In a further embodiment, the PAH content of the VGO ranges from about 1,000 to about 600,000 ppm-wt. The PAH content may be determined using comprehensive two-dimensional gas chromatography or ASTM D2425 or ASTM D3239 or by high resolution mass spectrometry or by the combination of any of these techniques.

Processes according to the invention remove a PAH from VGO. That is, the invention removes at least one PAH. It is understood that VGO will usually comprise a plurality of PAHs of different types in various amounts. Thus, the invention removes at least a portion of at least one type of PAH from the VGO. The invention may remove the same or different amounts of each type of PAH, and some types of PAH may not be removed. In an embodiment, the PAH content of the VGO is reduced by at least 10 wt %. In another embodiment, the PAH content of the VGO is reduced by at least 25 wt %.

A method of classifying PAHs is to use Clar's Rule. Erich Clar developed a rule (The Aromatic Sextet, John Wiley and Sons, 1972; see also a discussion by Milan Randic Chem. Rev. 2003, 103, 3449-605) which states that the Kekulé resonance structure of a PAH molecule with the greatest number of disjoint aromatic π-sextets (or benzene-like moieties) is the structure of greatest importance to the properties of a PAH. A disjoint aromatic π-sextet is defined as 6 π-electrons contained within a benzene-like ring that is separated from adjacent rings by C—C single bonds. Formula I gives the Clar's Rule structure for several PAHs. As an example, the application of Clar's Rule to phenanthrene gives a structure containing 2 disjoint aromatic π-sextets as the greatest number of benzene-like moieties as shown in Formula II. The greater the number of disjoint aromatic π-sextets, the more "aromatic" a molecule is. A PAH can have more than one Clar Rule structure as shown in Formula I, however the number of disjoint aromatic π-sextets is the same in these structures. In an embodiment, the invention is a process for removing PAHs with a Clar's Rule structure of greater than or equal to one disjoint aromatic π-sextet from a VGO feed by use of a phosphonium ionic liquid. In a further embodiment, the PAHs with greater than or equal to one disjoint aromatic π-sextet are reduced by at least 25%. In a further embodiment, PAHs with greater than or equal to 2 disjoint aromatic π-sextets are reduced by at least 40%. In yet a further embodiment, PAHs with greater than or equal to 3 disjoint aromatic π-sextets are reduced by at least 50%.

Formula I

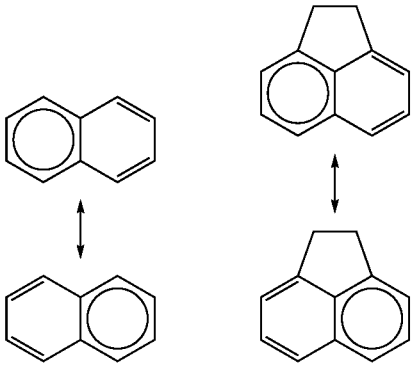

naphthalene acenaphthalene

-continued

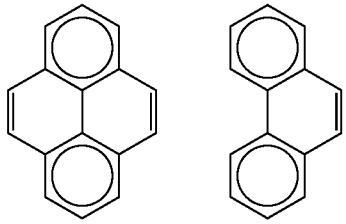

pyrene phenanthrene

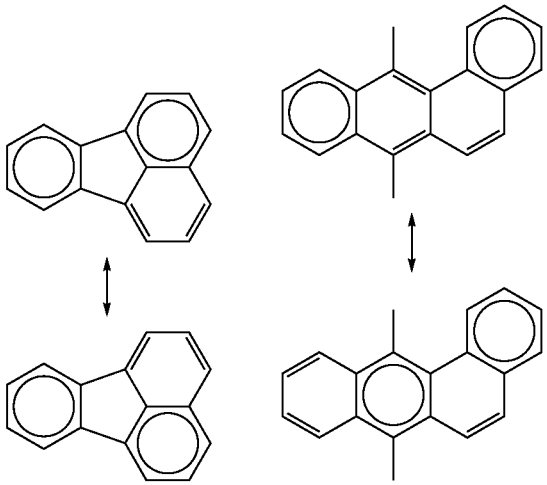

fluoranthene 7,12-dimethylbenzanthracene

Formula II

Kekule Structure Clar Representation

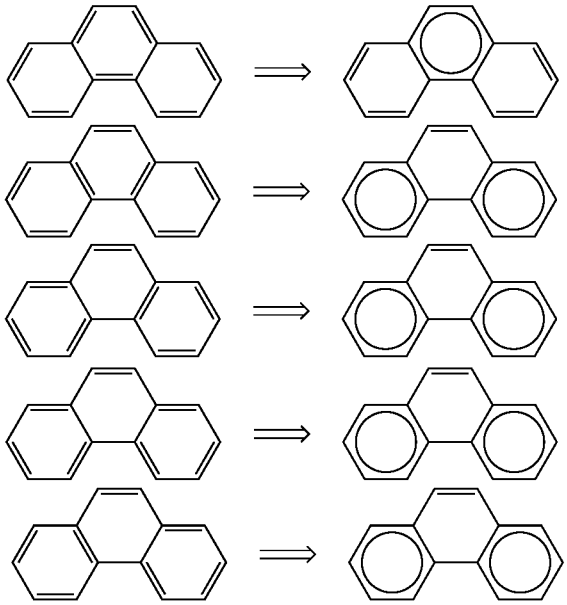

One or more ionic liquids are used to extract one or more PAH compounds from VGO. Generally, ionic liquids are non-aqueous, organic salts composed of ions where the positive ion is charge balanced with negative ion. These materials have low melting points, often below 100° C., undetectable vapor pressure and good chemical and thermal stability. The cationic charge of the salt is localized over hetero atoms, such as nitrogen, phosphorous, sulfur, arsenic, boron, antimony, and aluminum, and the anions may be any inorganic, organic, or organometallic species.

Ionic liquids suitable for use in the instant invention are VGO-immiscible phosphonium ionic liquids. As used herein the term "VGO-immiscible phosphonium ionic liquid" means an ionic liquid having a cation comprising at least one phosphorous atom and which is capable of forming a separate phase from VGO under operating conditions of the process. Ionic liquids that are miscible with VGO at the process conditions will be completely soluble with the VGO; therefore, no phase separation will be feasible. Thus, VGO-immiscible phosphonium ionic liquids may be insoluble with or partially soluble with VGO under operating conditions. A phosphonium ionic liquid capable of forming a separate phase from the VGO under the operating conditions is considered to be VGO-immiscible. Ionic liquids according to the invention may be insoluble, partially soluble, or completely soluble (miscible) with water.

In an embodiment, the VGO-immiscible phosphonium ionic liquid comprises at least one ionic liquid from at least one of the following groups of ionic liquids: tetraalkylphosphonium dialkylphosphates, tetraalkylphosphonium dialkyl phosphinates, tetraalkylphosphonium phosphates, tetraalkylphosphonium tosylates, tetraalkylphosphonium sulfates, tetraalkylphosphonium sulfonates, tetraalkylphosphonium carbonates, tetraalkylphosphonium metalates, oxometalates, tetraalkylphosphonium mixed metalates, tetraalkylphosphonium polyoxometalates, and tetraalkylphosphonium halides. In another embodiment, the VGO-immiscible phosphonium ionic liquid comprises at least one of trihexyl(tetradecyl) phosphonium chloride, trihexyl(tetradecyl)phosphonium bromide, tributyl(methyl)phosphonium bromide, tributyl(methyl)phosphonium chloride, tributyl(hexyl)phosphonium bromide, tributyl(hexyl)phosphonium chloride, tributyl(octyl)phosphonium bromide, tributyl(octyl)phosphonium chloride, tributyl(decyl)phosphonium bromide, tributyl(decyl) phosphonium chloride, tetrabutylphosphonium bromide, tetrabutylphosphonium chloride, triisobutyl(methyl)phosphonium tosylate, tributyl(methyl)phosphonium methylsulfate, tributyl(ethyl)phosphonium diethylphosphate, and tetrabutylphosphonium methanesulfonate. In a further embodiment, the VGO-immiscible phosphonium ionic liquid is selected from the group consisting of trihexyl(tetradecyl) phosphonium chloride, trihexyl(tetradecyl)phosphonium bromide, tributyl(methyl)phosphonium bromide, tributyl(methyl)phosphonium chloride, tributyl(hexyl)phosphonium bromide, tributyl(hexyl)phosphonium chloride, tributyl(octyl)phosphonium bromide, tributyl(octyl)phosphonium chloride, tributyl(decyl)phosphonium bromide, tributyl(decyl) phosphonium chloride, tetrabutylphosphonium bromide, tetrabutylphosphonium chloride, triisobutyl(methyl)phosphonium tosylate, tributyl(methyl)phosphonium methylsulfate, tributyl(ethyl)phosphonium diethylphosphate, tetrabutylphosphonium methanesulfonate, and combinations thereof. The VGO-immiscible phosphonium ionic liquid may be selected from the group consisting of trihexyl(tetradecyl) phosphonium halides, tetraalkylphosphonium dialkylphosphates, tetraalkylphosphonium tosylates, tetraalkylphosphonium sulfonates, tetraalkylphosphonium halides, and combinations thereof. The VGO-immiscible phosphonium ionic liquid may comprise at least one ionic liquid from at least one of the following groups of ionic liquids trihexyl (tetradecyl)phosphonium halides, tetraalkylphosphonium dialkylphosphates, tetraalkylphosphonium tosylates, tetraalkylphosphonium sulfonates, and tetraalkylphosphonium halides.

In an embodiment, the invention is a process for removing polycyclic aromatic hydrocarbon (PAH) compounds from vacuum gas oil (VGO) comprising a contacting step and a separating step. In the contacting step, VGO comprising a PAH and a VGO-immiscible phosphonium ionic liquid are contacted or mixed. The contacting may facilitate transfer or extraction of the one or more PAHs from the VGO to the ionic liquid. Although a VGO-immiscible phosphonium ionic liquid that is partially soluble in VGO may facilitate transfer of the PAH from the VGO to the ionic liquid, partial solubility is not required. Insoluble VGO/ionic liquid mixtures may have sufficient interfacial surface area between the VGO and ionic liquid to be useful. In the separation step, the mixture of VGO and ionic liquid settles or forms two phases, a VGO phase and an ionic liquid phase, which are separated to produce a VGO-immiscible phosphonium ionic liquid effluent and a VGO effluent.

The process may be conducted in various equipment which are well known in the art and are suitable for batch or continuous operation. For example, in a small scale form of the invention, VGO and a VGO-immiscible phosphonium ionic liquid may be mixed in a beaker, flask, or other vessel, e.g., by stirring, shaking, use of a mixer, or a magnetic stirrer. The mixing or agitation is stopped and the mixture forms a VGO phase and an ionic liquid phase which can be separated, for example, by decanting, centrifugation, or use of a pipette to produce a VGO effluent having a lower highly aromatic compounds content relative to the VGO. The process also produces a VGO-immiscible phosphonium ionic liquid effluent comprising the one or more PAH compounds.

The contacting and separating steps may be repeated, for example, when the PAH content of the VGO effluent is to be reduced further to obtain a desired PAH level in the ultimate VGO product stream from the process. Each set, group, or pair of contacting and separating steps may be referred to as a PAH removal step. Thus, the invention encompasses single and multiple PAH removal steps. A PAH removal zone may be used to perform a PAH removal step. As used herein, the term "zone" can refer to one or more equipment items or one or more sub-zones. Equipment items may include, for example, one or more vessels, heaters, separators, exchangers, conduits, pumps, compressors, and controllers. Additionally, an equipment item can further include one or more zones or sub-zones. The PAH removal process or step may be conducted in a similar manner and with similar equipment as is used to conduct other liquid-liquid wash and extraction operations. Suitable equipment includes, for example, columns with: trays, packing, rotating discs or plates, and static mixers. Pulse columns and mixing/settling tanks may also be used.

The PAH compound removal step may be conducted under PAH removal conditions including temperatures and pressures sufficient to keep the VGO-immiscible phosphonium ionic liquid and VGO feeds and effluents as liquids. For example, the PAH removal step temperature may range between about 10° C. and less than the decomposition temperature of the phosphonium ionic liquid; and the pressure may range between about atmospheric pressure and about 700 kPa(g). When the VGO-immiscible ionic liquid comprises more than one ionic liquid component, the decomposition temperature of the ionic liquid is the lowest temperature at which any of the ionic liquid components decompose. The PAH removal step may be conducted at a uniform temperature and pressure or the contacting and separating steps of the PAH removal step may be operated at different temperatures and/or pressures. In an embodiment, the contacting step is conducted at a first temperature, and the separating step is conducted at a temperature at least 5° C. lower than the first temperature. In a non-limiting example, the first temperature is about 80° C. Such temperature differences may facilitate separation of the VGO and ionic liquid phases.

The above and other PAH removal step conditions such as the contacting or mixing time, the separation or settling time, and the ratio of VGO feed to VGO-immiscible phosphonium ionic liquid (lean ionic liquid) may vary greatly based, for example, on the specific ionic liquid or liquids employed, the nature of the VGO feed (straight run or previously processed), the PAH content of the VGO feed, the degree and type of PAH removal required, the number of PAH removal steps employed, and the specific equipment used. In general, it is expected that contacting time may range from less than one minute to about two hours; settling time may range from about one minute to about eight hours; and the weight ratio of VGO feed to lean ionic liquid introduced to the PAH removal step may range from 1:10,000 to 10,000:1. In an embodiment, the weight ratio of VGO feed to lean ionic liquid may range from about 1:1,000 to about 1,000:1; and the weight ratio of VGO feed to lean ionic liquid may range from about 1:100 to about 100:1. In an embodiment, the weight of VGO feed is greater than the weight of ionic liquid introduced to the PAH removal step.

In an embodiment, a PAH removal step reduces the PAH content of the VGO by more than about 10 wt %. In another embodiment, more than about 25% of the PAH content by weight is extracted or removed from the VGO feed in a single PAH removal step. In an embodiment, PAH compounds with greater than or equal to one disjoint aromatic π-sextet are removed from the VGO feed in a PAH removal step and in a more specific embodiment, more than about 25% of the PAHs by weight with greater than or equal to one disjoint aromatic π-sextet may be extracted or removed from the VGO feed in a single PAH removal step. In a specific embodiment, more than about 40% of the PAHs by weight with greater than or equal to two disjoint aromatic π-sextets may be extracted or removed from the VGO feed in a single PAH removal step. In a further specific embodiment, more than about 50% of the PAHs by weight with greater than or equal to three disjoint aromatic π-sextets may be extracted or removed from the VGO feed in a single PAH removal step. As discussed herein, the invention encompasses multiple PAH removal steps to provide the desired amount of PAH removal. The degree of phase separation between the VGO and ionic liquid phases is another factor to consider as it affects recovery of the ionic liquid and VGO. The degree of PAH removed and the recovery of the VGO and ionic liquids may be affected differently by the nature of the VGO feed, the specific ionic liquid or liquids, the equipment, and the PAH removal conditions such as those discussed above.

The amount of water present in the VGO/VGO-immiscible phosphonium ionic liquid mixture during the PAH removal step may also affect the amount of PAHs removed and/or the degree of phase separation, i.e., recovery of the VGO and ionic liquid. In an embodiment, the VGO/VGO-immiscible phosphonium ionic liquid mixture has a water content of less than about 10% relative to the weight of the ionic liquid. In another embodiment, the water content of the VGO/VGO-immiscible phosphonium ionic liquid mixture is less than about 5% relative to the weight of the ionic liquid; and the water content of the VGO/VGO-immiscible phosphonium ionic liquid mixture may be less than about 2% relative to the weight of the ionic liquid. In a further embodiment, the VGO/VGO-immiscible phosphonium ionic liquid mixture is water free, i.e., the mixture does not contain water.

The invention can be applied to a full VGO, that has not been hydrotreated, or to a partially hydrotreated VGO or to other PAH containing feedstocks. Experiments have demonstrated that ionic liquids can extract PAHs such as phenanthrene, fluoroanthrene and pyrene from VGO.

In particular, the examples show triisobutyl(methyl)phosphonium tosylate (Cyphos 106) and tributyl(ethyl)phosphonium diethylphosphate (Cyphos 169) ionic liquids have been found to extract PAHs from VGO at 80° C. and a ratio of 1:0.5 VGO:Ionic Liquid.

EXAMPLE 1

A sample of VGO with very low contaminant levels was obtained which had an API of 33.7 and a H/C ratio of 1.90. Of the VGO, 10.3% boiled between 204° and 343° C. and 89.1% boiled between 344° and 524° C. This VGO was then spiked with a collection of VGO range hydrocarbon compounds, some of which are PAH compounds. The spiked feed was then extracted with either Cyphos 106 or Cyphos 169 ionic liquid and characterized by comprehensive two-dimensional gas chromatography. Extraction levels of various hydrocarbon and PAH molecules are shown in the Table 1. PAHs containing greater than or equal to 2 disjoint aromatic π-sextets are extracted with the highest efficiency.

TABLE 1

| Compounds | Original Concentration (ppm) | Cyphos 106 Extracted % | Cyphos 169 Extracted % |
|---|---|---|---|
| Eicosane | 380 | 1.90 | 1.33 |
| Pentacosane | 409 | 4.83 | 2.00 |
| 1,2,4,5-Tetra-isopropylbenzene | 679 | 14.63 | 10.34 |
| 1-Phenyldecane | 569 | 8.03 | 9.12 |
| 1,1,4,4,5,5,8,8-Octamethyl-1,2,3,4,5,6,7,8-octahydroanthracene | 383 | 8.59 | 11.51 |
| Tridecylbenzene | 651 | 9.46 | 20.18 |
| Phenanthrene | 544 | 40.17 | 43.19 |
| 1,2,3,6,7,8-Hexahydropyrene | 728 | 13.31 | 12.83 |
| Fluoranthrene | 475 | 46.01 | 50.01 |
| Pyrene | 863 | 44.68 | 46.30 |
| 9,10-Dimethylanthracene | 473 | 6.61 | 0.00 |
| 7,12-Dimethyl-benz[a]anthracene | 407 | 15.26 | 14.48 |

EXAMPLE 2

Three PAHs (i.e., naphthalene, phenanthrene and benzo[b] fluoroanthrene) were spiked in another VGO with a low contaminant level. This VGO had an API of 26.8 and a H/C ratio of 1.72. Of the VGO, 12.5% boiled between 204° and 343° C., and 82.7% boiled between 344° and 524° C. The spiked feed was then extracted with either Cyphos 106 or Cyphos 169 ionic liquid and characterized by comprehensive two-dimensional gas chromatography. Extraction efficiency for those three compounds is shown in the Table 2. benzo[b]fluoroanthrene, which possesses 3 disjoint aromatic π-sextets is extracted with the highest efficiency for both ionic liquids.

TABLE 2

| Compounds | Original Concentration (ppm) | Cyphos 106 Extracted % | Cyphos 169 Extracted % |
|---|---|---|---|
| Naphthalene | 440 | 62.36 | 46.85 |
| Phenanthrene | 528 | 57.46 | 55.29 |
| Benzo[b]fluoroanthrene | 434 | 87.85 | 64.12 |

EXAMPLE 3

A VGO was acquired which had an API of 20.9 and a H/C ratio of 1.69. Of the VGO, 3.97% boiled between 204° and 343° C., and 88.4% boiled between 344° and 524° C. It contained 2.35% 5 and 1300 ppm N. The VGO was then extracted with Cyphos 106 ionic liquid and characterized by comprehensive two-dimensional gas chromatography before and after extraction. Extraction efficiency for several PAH compounds is shown in Table 3.

TABLE 3

| Sample | VGO | Extracted VGO1 | Extract % |
|---|---|---|---|
| VGO:Cyphos 106 | | 2:1 | |
| | Mass-PPM | Mass-PPM | |
| Phenanthrene & Anthracene | 420 | 130 | 69.0 |
| C1, C2 & C3 Substituted Phenanthrenes &Anthracenes | 8090 | 6910 | 14.6 |
| C4, C5 & C6 Substituted Phenanthrenes &Anthracenes | 16090 | 15500 | 3.7 |
| Pyrene | 230 | 0 | 100.0 |
| C1, C2, C3 & C4 Substituted Pyrenes | 15790 | 11120 | 29.6 |
| C5, C6, C7 & C8 Substituted Pyrenes | 36520 | 28460 | 22.1 |

The degree of branching on the PAH affects the efficiency of extraction during the PAH removal step. PAHs with less substitution are removed with higher efficiency than un-substituted PAHs.

EXAMPLE 4

A VGO was acquired which had an API of 26.9 and a H/C ratio of 1.73. Of the VGO, 7.32% boiled between 204° and 343° C., and 75.95% boiled between 344° and 524° C. It contained 0.58% S and 1125 ppm N. The VGO was then extracted with Cyphos 106 ionic liquid and characterized by comprehensive two-dimensional gas chromatography before and after extraction. Extraction efficiency for several PAH compounds is shown in Table 4.

TABLE 4

| Sample | VGO | Extracted VGO | Extract % |
|---|---|---|---|
| VGO:Cyphos 106 | | 1:1 | |
| | Mass-PPM | Mass-PPM | |
| Phenanthrene & Anthracene | 148 | 64 | 56.8 |
| C1, C2 & C3 Substituted Phenanthrenes & Anthracenes | 4318 | 3033 | 29.8 |
| C4, C5 & C6 Substituted Phenanthrenes & Anthracenes | 10355 | 7918 | 23.5 |
| Pyrene | 66 | 12 | 81.8 |
| C1, C2, C3 & C4 Substituted Pyrenes | 6722 | 4502 | 33.0 |
| C5, C6, C7 & C8 Substituted Pyrenes | 18262 | 12683 | 30.5 |

Again, it can be seen that the degree of branching on the PAH affects the efficiency of extraction during the PAH removal step. PAHs with less substitution are removed with higher efficiency than un-substituted PAHs.

The invention claimed is:

1. A process for removing a polycyclic aromatic hydrocarbon compound from a vacuum gas oil comprising:

(a) contacting the vacuum gas oil comprising the polycyclic aromatic hydrocarbon compound with a vacuum gas oil-immiscible phosphonium ionic liquid to produce a mixture comprising the vacuum gas oil and the vacuum gas oil-immiscible phosphonium ionic liquid; and (b) separating the mixture to produce a vacuum gas oil effluent and a vacuum gas oil-immiscible phosphonium ionic liquid effluent, the vacuum gas oil-immiscible phosphonium ionic liquid effluent comprising the polycyclic aromatic hydrocarbon compound;

wherein the vacuum gas oil-immiscible phosphonium ionic liquid comprises at least one ionic liquid from at least one of tetraalkylphosphonium dialkylphosphates, tetraalkylphosphonium dialkyl phosphinates, tetraalkylphosphonium phosphates, tetraalkylphosphonium tosylates, tetraalkylphosphonium sulfates, tetraalkylphosphonium sulfonates, tetraalkylphosphonium carbonates, tetraalkylphosphonium metalates, oxometalates, tetraalkylphosphonium mixed metalates, tetraalkylphosphonium polyoxometalates, tetraalkylphosphonium halides, trihexyl(tetradecyl)phosphonium chloride, trihexyl(tetradecyl)phosphonium bromide, tributyl(methyl)phosphonium bromide, tributyl(methyl) phosphonium chloride, tributyl(hexyl)phosphonium bromide, tributyl(hexyl)phosphonium chloride, tributyl(octyl) phosphonium bromide, tributyl(octyl)phosphonium chloride, tributyl(decyl)phosphonium bromide, tributyl(decyl)phosphonium chloride, tetrabutylphosphonium bromide, tetrabutylphosphonium chloride, triisobutyl(methyl)phosphonium tosylate, tributyl(methyl)phosphonium methylsulfate, tributyl(ethyl)phosphonium diethylphosphate, and tetrabutylphosphonium methanesulfonate;

wherein more than 40% of polycyclic aromatic content by weight with greater than or equal to two disjoint aromatic π-sextets is removed.

2. The process of claim 1 wherein the mixture is water free.

3. The process of claim 1 wherein the mixture further comprises water in an amount less than 10% relative to the amount of vacuum gas oil-immiscible phosphonium ionic liquid in the mixture on a weight basis.

4. The process of claim 1 wherein the amount of polycyclic aromatic hydrocarbon compounds is reduced by at least 25 wt %.

5. The process of claim 1 further comprising passing at least a portion of the vacuum gas oil effluent to a hydrocarbon conversion process.

6. The process of claim 1 further comprising washing at least a portion of the vacuum gas oil effluent with water to produce a washed vacuum gas oil stream and a spent water stream.

7. The process of claim 6 further comprising passing at least a portion of the washed vacuum gas oil stream to a hydrocarbon conversion process.

8. The process of claim 1 further comprising contacting the vacuum gas oil-immiscible phosphonium ionic liquid effluent with a regeneration solvent and separating the vacuum gas oil-immiscible phosphonium ionic liquid effluent from the regeneration solvent to produce an extract stream comprising the polycyclic aromatic hydrocarbon compound and a regenerated vacuum gas oil-immiscible phosphonium ionic liquid stream.

9. The process of claim 8 further comprising recycling at least a portion of the regenerated vacuum gas oil-immiscible phosphonium ionic liquid stream to the polycyclic aromatic hydrocarbon removal contacting.

10. The process of claim 8 wherein the regeneration solvent comprises water and the regenerated vacuum gas oil-immiscible phosphonium ionic liquid stream comprises water.

11. The process of claim 10 wherein the vacuum gas oil effluent comprises vacuum gas oil-immiscible phosphonium ionic liquid, further comprising washing at least a portion of the vacuum gas oil effluent with water to produce a washed vacuum gas oil and a spent water stream, the spent water stream comprising the vacuum gas oil-immiscible phosphonium ionic liquid; wherein at least a portion of the spent water stream is at least a portion of the regeneration solvent.

12. The process of claim 11 further comprising drying at least a portion of at least one of the regenerated vacuum gas oil-immiscible phosphonium ionic liquid stream and the spent water stream to produce a dried vacuum gas oil-immiscible phosphonium ionic liquid stream.

13. The process of claim 12 further comprising recycling at least a portion of the dried vacuum gas oil-immiscible phosphonium ionic liquid stream to the polycyclic aromatic hydrocarbon compound removal contacting step.

14. A process for removing a polycyclic aromatic hydrocarbon compound from a vacuum gas oil comprising:

(a) contacting the vacuum gas oil comprising the polycyclic aromatic hydrocarbon compound with a vacuum gas oil-immiscible phosphonium ionic liquid to produce a mixture comprising the vacuum gas oil, and the vacuum gas oil-immiscible phosphonium ionic liquid;

(b) separating the mixture to produce a vacuum gas oil effluent and a vacuum gas oil-immiscible phosphonium ionic liquid effluent, the vacuum gas oil-immiscible phosphonium ionic liquid effluent comprising the polycyclic aromatic hydrocarbon compound;

(c) washing at least a portion of the vacuum gas oil effluent with water to produce a washed vacuum gas oil stream and a spent water stream;

(d) contacting the vacuum gas oil-immiscible phosphonium ionic liquid effluent with a regeneration solvent and separating the vacuum gas oil-immiscible phosphonium ionic liquid effluent from the regeneration solvent to produce an extract stream comprising the polycyclic aromatic hydrocarbon compound and a regenerated vacuum gas oil-immiscible phosphonium ionic liquid stream; and (e) drying at least a portion of at least one of the vacuum gas oil-immiscible phosphonium ionic liquid effluent, the spent water stream, and the regenerated vacuum gas oil-immiscible phosphonium ionic liquid stream to produce a dried vacuum gas oil-immiscible phosphonium ionic liquid stream.

15. The process of claim 14 further comprising recycling at least a portion of at least one of the vacuum gas oil-immiscible phosphonium ionic liquid effluent, the spent water stream, the regenerated vacuum gas oil-immiscible phosphonium ionic liquid stream, and the dried vacuum gas oil-immiscible phosphonium ionic liquid stream to the polycyclic aromatic hydrocarbon compound removal contacting step.

16. The process of claim 14 wherein more than about 25% of the polycyclic aromatic hydrocarbon by weight with greater than or equal to one disjoint aromatic π-sextet may be extracted or removed from the vacuum gas oil feed in a single polycyclic aromatic hydrocarbon removal step.

* * * * *